US007021181B1

(12) United States Patent
Chi

(10) Patent No.: US 7,021,181 B1
(45) Date of Patent: Apr. 4, 2006

(54) SCREWDRIVER HAVING ROTATABLE MAGAZINE

(76) Inventor: Li-Lien Chi, No. 97, Tsuah Lane, Sanho Tsuen, Sec. 3, Chonsan Road, Wuji Hsiang, Taichung, 414 (TW)

( * ) Notice: Subject to any disclaimer, the term of this patent is extended or adjusted under 35 U.S.C. 154(b) by 0 days.

(21) Appl. No.: 11/047,807

(22) Filed: Feb. 1, 2005

(51) Int. Cl.

| | |
|---|---|
| ***B25G 1/08*** | (2006.01) |
| ***B25G 1/00*** | (2006.01) |
| ***B25B 23/16*** | (2006.01) |
| ***B25B 23/00*** | (2006.01) |
| ***B25F 1/00*** | (2006.01) |

(52) U.S. Cl. ..... 81/490; 81/177.4; 81/438; 81/439; 81/437; 81/177.1; 81/177.2

(58) Field of Classification Search ..... 81/490, 81/177.4, 437–438, 177.1, 177.2
See application file for complete search history.

(56) References Cited

U.S. PATENT DOCUMENTS

| | | | | | |
|---|---|---|---|---|---|
| 148,888 | A | * | 3/1874 | Kidder | 81/490 |
| 463,507 | A | * | 11/1891 | Goodell et al. | 408/198 |
| 648,589 | A | * | 5/1900 | Lanfair | 81/490 |
| 4,716,796 | A | | 1/1988 | Corona et al. | 81/177.4 |
| 4,880,668 | A | * | 11/1989 | Hayes et al. | 427/162 |
| 4,924,733 | A | * | 5/1990 | McKenzie | 81/438 |
| 5,265,504 | A | * | 11/1993 | Fruhm | 81/439 |
| 5,613,413 | A | | 3/1997 | Huang | 81/490 |
| 6,220,129 | B1 | | 4/2001 | Shimansky | 81/490 |
| 6,305,815 | B1 | * | 10/2001 | Lin | 362/119 |
| 6,327,942 | B1 | * | 12/2001 | Mariol et al. | 81/177.4 |
| 6,443,037 | B1 | * | 9/2002 | Chang | 81/62 |
| 6,502,484 | B1 | * | 1/2003 | Pao-Hsi | 81/439 |
| 6,928,908 | B1 | * | 8/2005 | Yu | 81/490 |
| 2005/0092144 | A1 | * | 5/2005 | Shiao | 81/490 |

* cited by examiner

*Primary Examiner*—Joseph J. Hail, III
*Assistant Examiner*—Bryan Muller
(74) *Attorney, Agent, or Firm*—Charles E. Baxley

(57) ABSTRACT

A screwdriver includes a handle having one or more blades formed in a lower portion for grasping a driving shank with a control ferrule. A magazine is rotatably received in the handle, and includes a number of compartments formed between ribs, for receiving screwdriver bits, and includes one or more projections. A cover is attached to the handle, to rotatably retain the magazine within the handle, and includes a passage for selectively aligning with either of the compartments or the ribs of the magazine. The cover includes a number of depressions to receive the projection of the magazine, and to align either of the compartments or the ribs of the magazine with the passage of the cover.

7 Claims, 4 Drawing Sheets

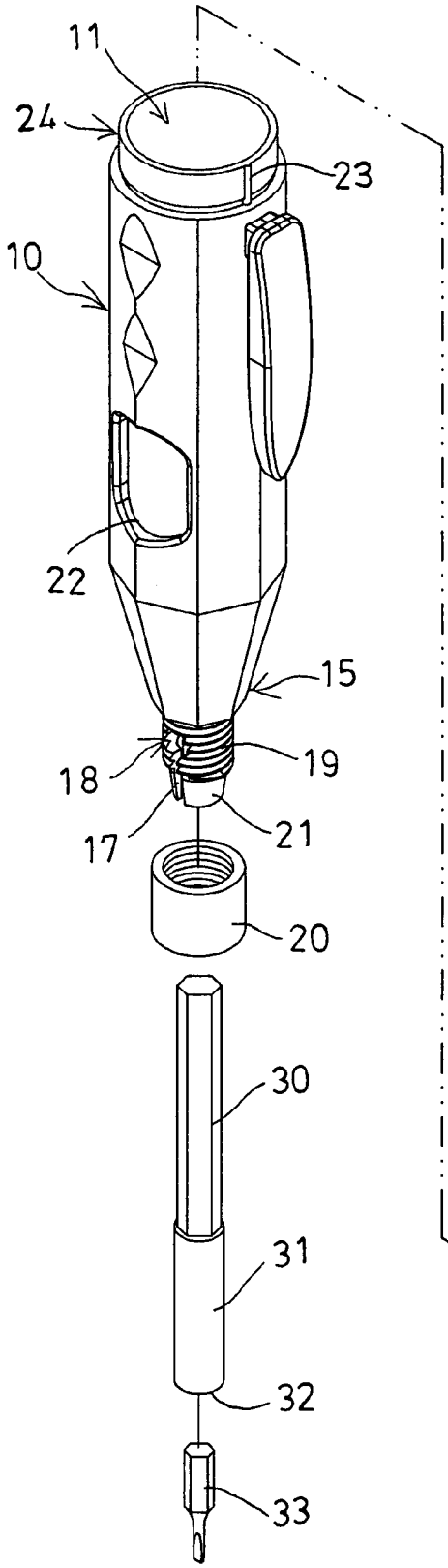
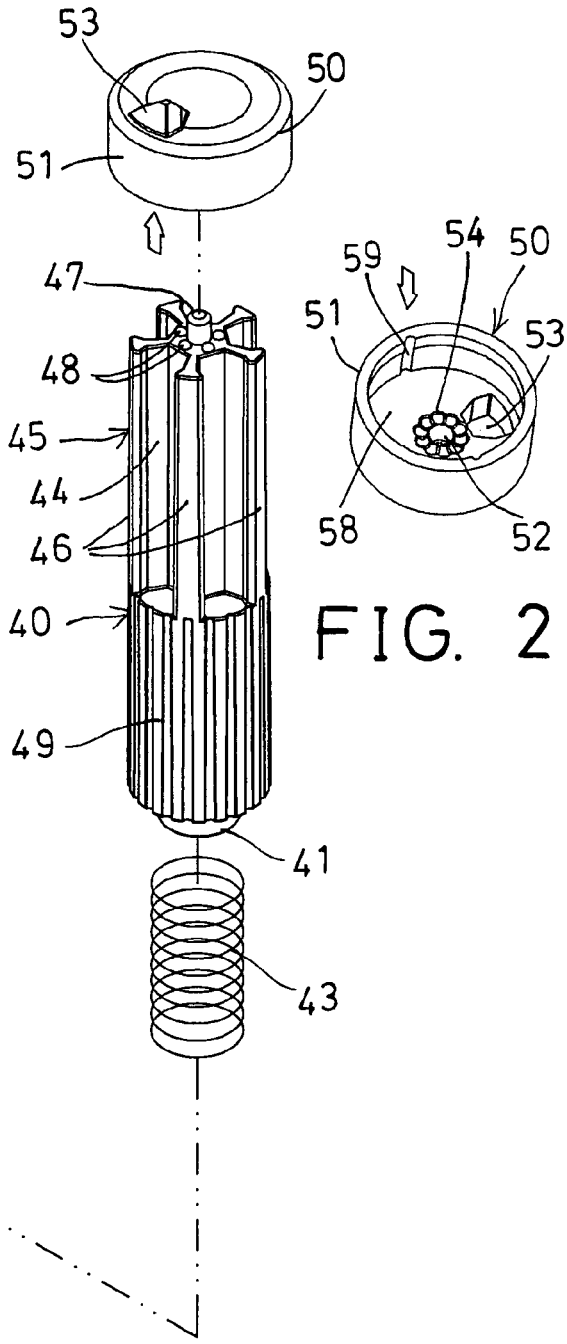
FIG. 2
FIG. 1

SCREWDRIVER HAVING ROTATABLE MAGAZINE

BACKGROUND OF THE INVENTION

1. Field of the Invention

The present invention relates to a screwdriver, and more particularly to a screwdriver having a rotatable magazine received within a handle housing for suitably receiving screw driver bits therein, and for preventing the screw driver bits from being disengaged from the handle housing inadvertently.

2. Description of the Prior Art

Typical screwdrivers comprise a handle portion, and a driver shank attachable to the handle portion for being rotated or driven by the handle portion. Normally, the handle portion includes one or more chambers or spaces formed therein, for receiving screw driver bits therein.

For example, U.S. Pat. No. 4,716,796 to Corona et al. discloses one of the typical screwdrivers comprising a handle portion including a magazine having a number of channels formed therein, in which all of the channels of the magazine include their outer portions opening to the outer periphery of the handle. However, dirt, contaminants, particles, or other objects may enter into the channels of the magazine easily, such that the magazine may not be easily cleaned.

U.S. Pat. No. 4,924,733 to McKenzie discloses another typical screwdriver comprising a handle portion including a magazine having a number of longitudinal bores formed therein and arranged in a circular array, for receiving tool bits therein, and a rotatable end cap attached to the handle and provided with a slot for receiving the bits, and for selecting a desired bit by rotationg the end cap to align the slot with a particular bore.

However, the selected bit is withdrawn from the magazine by inserting a second bit into the bore through the slot in the end cap, thereby forcing the selected bit out of the bore through the opposite ends. However, the tool bits received in the longitudinal bores of the magazine may have a good chance to be disengaged from the magazine inadvertently after use.

U.S. Pat. No. 5,265,504 to Fruhm discloses a further typical screwdriver comprising an injection molded hollow handle portion including a breach loading magazine to store a number of tool bits. The magazine is enclosed inside the hollow handle and is extracted along the axis of the screwdriver when the end cap of the handle is pulled. However, when the end cap of the handle is pulled, the tool bits may have a good chance to be disengaged from the magazine inadvertently.

U.S. Pat. No. 5,613,413 to Huang discloses a still further typical screwdriver comprising an injection molded hollow handle portion, and a cover including a number of upright barrels for receiving or storing screwdriver bits therein. However, when the cover is disengaged from the handle, the tool bits also may have a good chance to be disengaged from the cover inadvertently.

U.S. Pat. No. 6,220,129 to Shimansky discloses a still further typical screwdriver comprising a front handle section including a screw driver bit retention magazine formed in the rear circumferential wall end and having a number of cavities formed therein to receive the screw driver bits, and a rear handle section engageable onto the front handle section, for receiving or storing screwdriver bits therein. However, when the rear handle section is disengaged from the front handle section, the tool bits also may have a good chance to be disengaged from the front handle section inadvertently.

U.S. Pat. No. 6,305,815 to Lin discloses a still further typical screwdriver comprising a screw driver bit set slidably received in a handle, for receiving screw driver bits. When it is required to insert or to remove the screw driver bits from the screw driver bit set, the screw driver bit set is required to be pulled and removed from the handle. However, when the screw driver bit set is pulled and removed from the handle, the tool bits also may have a good chance to be disengaged from the screw driver bit set inadvertently.

The present invention has arisen to mitigate and/or obviate the afore-described disadvantages of the conventional screwdrivers.

SUMMARY OF THE INVENTION

The primary objective of the present invention is to provide a screwdriver including a rotatable magazine received within a handle housing for suitably receiving screw driver bits therein, and for preventing the screw driver bits from being disengaged from the handle housing inadvertently.

In accordance with one aspect of the invention, there is provided a screwdriver comprising a handle including a chamber formed therein, and includes a passage formed in a lower portion thereof and communicating with the chamber thereof, the handle including at least one slit formed in the lower portion thereof and communicating with the passage thereof, to form at least two blades, and including an outer thread formed in the lower portion thereof, and including an inclined surface formed in the at least two blades, the handle including at least one opening formed therein and communicating with the chamber thereof, a driving shank received in the passage of the handle and to be rotated and driven by the handle, a control ferrule threaded with the outer thread of the handle and engaged with the inclined surface of the at least two blades of the handle, to force the at least two blades to engage with and to grasp the driving shank to the handle, a magazine rotatably received in the chamber of the handle, and including a number of compartments formed therein and defined between ribs, for receiving screwdriver bits therein, and including at least one projection extended upwardly therefrom, and including a serrated outer surface provided thereon, the serrated outer surface of the magazine being exposed and reachable via the opening of the handle, to allow the magazine to be rotated relative to the handle by users, a cover attached to the handle, to enclose the chamber of the handle, and to rotatably retain the magazine within the chamber of the handle, the cover including a passage formed therein for selectively aligning with either of the compartments or either of the ribs of the magazine when the magazine is rotated relative to the handle, and the cover including a number of depressions formed therein to selectively receive the projection of the magazine, and to anchor and position the magazine relative to the handle at selected angular position, and to maintain either of the compartments and the ribs of the magazine in alignment with the passage of the cover. The screwdriver bits are engageable into and disengageable from the compartments of the magazine when either of the compartments of the magazine is aligned with the passage of the cover by rotating the magazine relative to the handle, the screwdriver bits are retained within the handle and being prevented from being disengaged from the handle and the magazine when either of the ribs of the magazine is aligned with the passage of the cover, by rotating the magazine relative to the handle and by offsetting the compartments of the magazine from the passage of the cover. A spring biasing device may further be provided for biasing the magazine toward the cover, to bias the projection of the magazine to engage into either of the depressions of the cover.

The handle includes a recess formed therein and communicating with the chamber thereof, and having an inner diameter smaller than that of the chamber thereof to form a peripheral shoulder between the recess and the chamber thereof, the magazine includes a shaft extended downwardly therefrom and rotatably engaged in the recess of the handle, to smoothly couple the magazine to the handle.

The magazine includes a space formed therein, the biasing device includes a spring member received in the space of the magazine. The shank includes a socket provided thereon for engaging with the screwdriver bits.

The handle includes at least one catch extended therefrom, and the cover includes a peripheral wall extended therefrom and having one notch to receive the catch of the handle, to enclose the chamber of the handle, and to rotatably retain the magazine within the chamber of the handle.

The magazine includes an axle extended upwardly therefrom, the cover includes a cavity formed therein to rotatably receive the axle of the magazine, and to allow the magazine to be smoothly and rotatably received within the handle by the axle. The cover includes a number of depressions equal to the number of compartments plus the number of ribs on the magazine.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 1 is an exploded view of a screwdriver in accordance with the present invention;

FIG. 2 is a bottom perspective view of an upper cover of the screwdriver;

DETAILED DESCRIPTION OF THE PREFERRED EMBODIMENT

Figure 3:
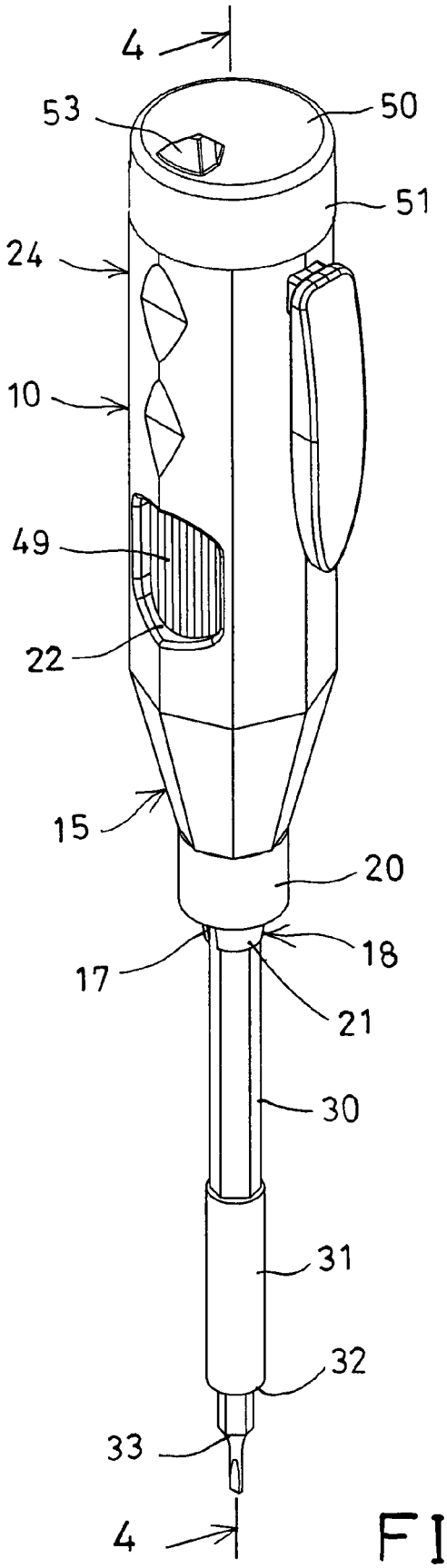
FIG. 3 is a perspective view of the screwdriver.
Figure 4:
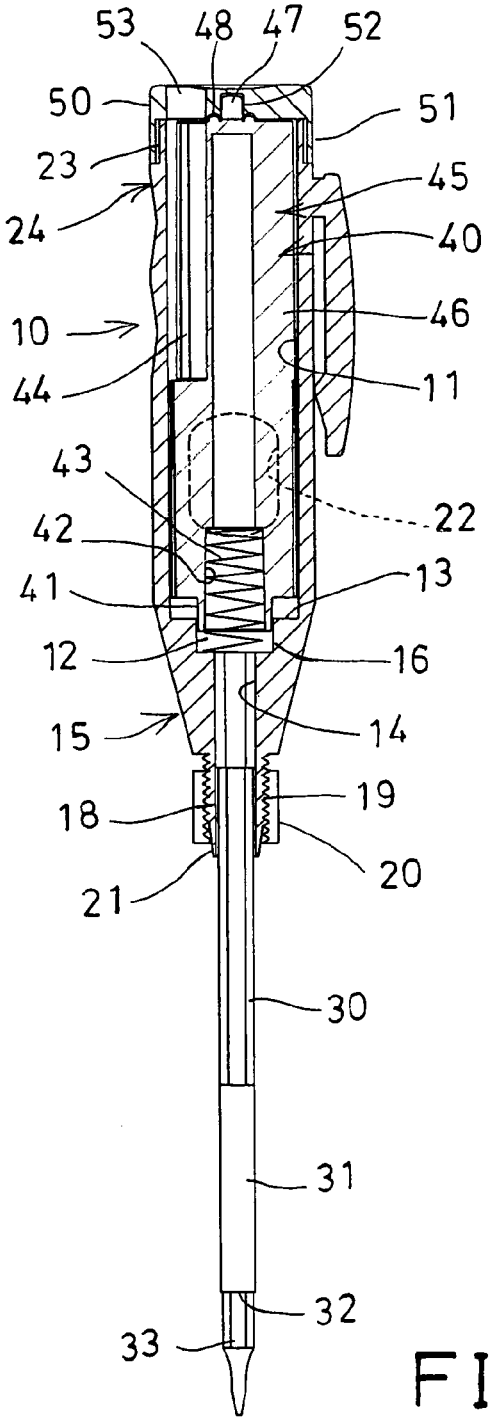
FIG. 4 is a partial cross sectional view of the screwdriver, taken along lines 4—4 of FIG. 3.

Referring to the drawings, and initially to FIGS. 1–5, a screwdriver in accordance with the present invention comprises a housing or handle 10 including a chamber 11 formed therein, and including a recess 12 formed in an intermediate portion thereof and communicating with the chamber 11 thereof, and having an inner diameter smaller than that of the chamber 11 thereof to form or define a peripheral shoulder 13 between the recess 12 and the chamber 11 thereof, best shown in FIG. 4.

The handle 10 further includes a passage 14 formed in a lower portion 15 thereof and communicating with the chamber 11 and the recess 12 thereof, and having an inner diameter smaller than that of the recess 12 thereof to form or define another peripheral shoulder 16 between the recess 12 and the passage 14 thereof. It is preferable that the passage 14 of the handle 10 includes a non-circular cross section, such as a hexagonal cross section, for receiving a driving shank 30 that includes the corresponding non-circular cross section, for allowing the driving shank 30 to be rotated or driven by the handle 10.

The handle 10 further includes one or more, such as two slits 17 formed in the lower portion 15 thereof and communicating with the passage 14 thereof, to form two or more blades 18 in the lower portion 15 thereof, and further includes an outer thread 19 formed in the lower portion 15 thereof and/or formed in the blades 18, for threading with a lock nut or a control ferrule 20, and further includes an inclined surface 21 formed in the bottom of the blades 18 or of the lower portion 15 of the handle 10.

The control ferrule 20 may be threaded or rotated relative to the blades 18, and may be engaged with the inclined surface 21 of the blades 18 or of the lower portion 15 of the handle 10, to force the blades 18 to engage with or to grasp or to grip the driving shank 30 in the handle 10. The driving shank 30 may be used for directly engaging with and for rotating or driving fasteners, or may include a socket 31 provided thereon and having an engaging hole 32 formed therein for receiving screwdriver bits 33 therein, and thus for allowing the screwdriver bits 33 to be rotated or driven or actuated by the driving shank 30.

Figure 6:
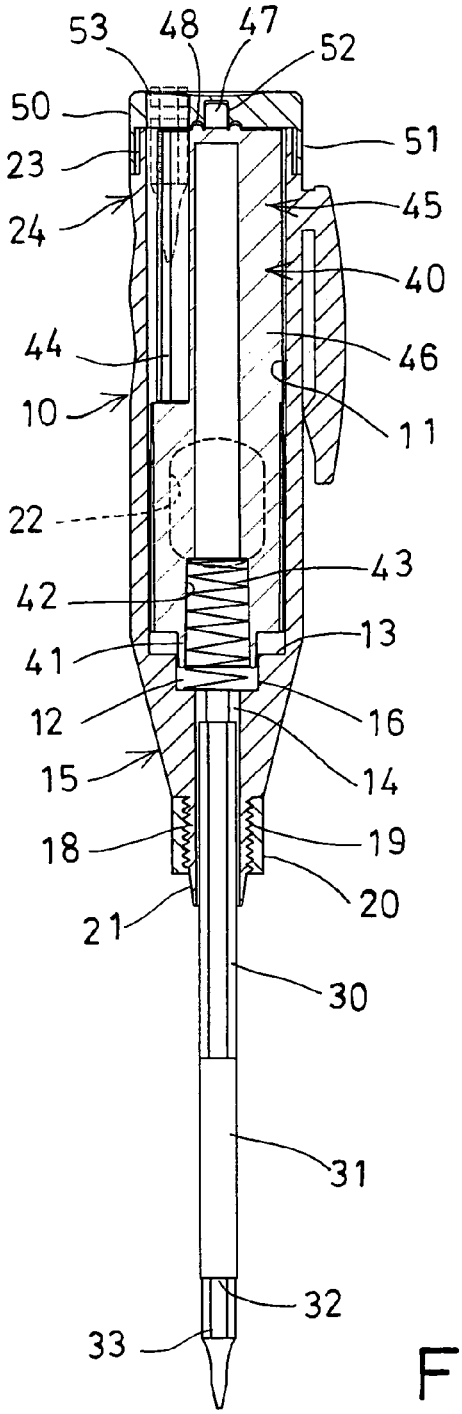
FIG. 6 is a partial cross sectional view similar to FIG. 4, illustrating the operation of the screwdriver.

A rotary magazine 40 is rotatably received in the chamber 11 of the handle 10, and includes a shaft 41 extended downwardly therefrom and rotatably engaged in the recess 12 of the handle 10, and includes a space 42 formed in the lower portion thereof, for receiving a spring biasing means or a spring member 43 therein. The spring member 43 may bias the magazine 40 away from the driving shank 30. As best shown in FIGS. 4 and 6, the space 42 of the magazine 40 is facing toward and communicating with the passage 14 of the handle 10, to selectively receive the driving shank 30.

Figure 7:
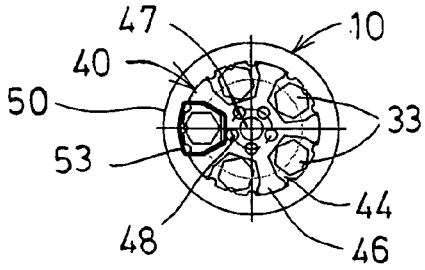
FIG. 7 is a top view of the screwdriver as shown in FIG. 6.

The magazine 40 includes one or more longitudinal compartments 44 formed in an upper portion 45 thereof, and defined between longitudinal ribs 46, for receiving or storing screwdriver bits 33 therein (FIGS. 5, 7), and includes an axle 47 extended upwardly therefrom, and further includes one or more projections 48 extended upwardly therefrom and located or arranged around the axle 47. It is preferable that the magazine 40 includes a serrated outer surface or includes a number of teeth 49 extended outwardly from the lower portion thereof, for allowing the magazine 40 to be easily rotated relative to the handle 10 by the users.

The handle 10 further includes one or more, such as two opposite openings 22 formed in the side or outer peripheral portion and communicating with the chamber 11 thereof, for exposing or for reaching the serrated outer surface or the teeth 49 of the magazine 40, best shown in FIG. 3, to allow the magazine 40 to be rotated relative to the handle 10 by the users. The handle 10 includes one or more catches 23 extended from the upper portion 24 thereof.

An upper cover 50 includes a peripheral wall 51 (FIG. 2), to form a compartment 58, and includes one or more notches 59 to receive the lock catches 23 of the handle 10, and to secure the cover 50 to the handle 10 with such as force-fitted engagements, and to enclose the chamber 11 of the handle 10, and thus to rotatably retain the rotary magazine 40 within the chamber 11 of the handle 10. The cover 50 includes a cavity 52 (FIG. 2) to rotatably receive the axle 47 of the magazine 40, and to allow the magazine 40 to be rotatably received within the handle 10 by the axle 47 and the shaft 41.

The cover 50 includes a passage 53 formed therein, for selectively aligning with either of the longitudinal compartments 44 or either of the longitudinal ribs 46 of the magazine 40 (FIGS. 4–7) when the magazine 40 is rotated relative to the handle 10 by the users. The cover 50 includes a number of depressions 54 formed therein (FIG. 2), and arranged or located around the cavity 52 thereof, to selectively receive the projections 48 of the magazine 40, and to anchor and position the magazine 40 relative to the handle 10 at the selected angular position, or to retain or to maintain the longitudinal compartments 44 and the longitudinal ribs 46 of the magazine 40 in selectively alignment with the passage 53 of the cover 50. The spring biasing means or spring member 43 may bias the magazine 40 toward the cover 50, and may thus bias the projections 48 of the magazine 40 to engage into the depressions 54 of the cover 50.

In operation, as shown in FIGS. 4–7, the magazine 40 may be rotated relative to the handle 10 by the users via the openings 22 of the handle 10 (FIG. 3), to align either of the longitudinal compartments 44 of the magazine 40 with the passage 53 of the cover 50 (FIGS. 6, 7), and thus to allow the screwdriver bits 33 to be engaged into the longitudinal compartments 44 of the magazine 40, or to be removed or disengaged from the magazine 40 and the handle 10 via the passage 53 of the cover 50.

Figure 5:
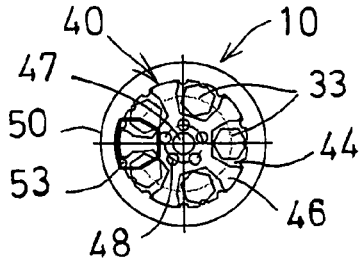
FIG. 5 is a top view of the screwdriver as shown in FIG. 4.

As shown in FIGS. 4 and 5, when it is no longer required to engage into or to disengage the screwdriver bits 33 from the magazine 40 and the handle 10, the magazine 40 may further be rotated relative to the handle 10 to align either of the longitudinal ribs 46 of the magazine 40 with the passage 53 of the cover 50, and thus to offset the screwdriver bits 33 from the passage 53 of the cover 50, such that the screwdriver bits 33 may be retained within the handle 10 and may be prevented from being disengaged from the handle 10.

As shown in FIGS. 1 and 2, the magazine 40 may include only one projection 48 extended upwardly therefrom, and the cover 50 may include a number of depressions 54 formed therein to selectively receive the single projection 48 of the magazine 40, and to anchor and position the magazine 40 relative to the handle 10 at the selected angular position, or to retain or to maintain the longitudinal compartments 44 and the longitudinal ribs 46 of the magazine 40 in selectively alignment with the passage 53 of the cover 50. It is preferable that the number of the depressions 54 of the cover 50 is equal to the number of the longitudinal compartments 44 of the magazine 40 plus the number of the longitudinal ribs 46 of the magazine 40.

Accordingly, the screwdriver in accordance with the present invention includes a rotatable magazine received within a handle housing for suitably receiving screw driver bits therein, and for preventing the screw driver bits from being disengaged from the handle housing inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A screwdriver comprising:

a handle including a chamber formed therein, and includes a passage formed in a lower portion thereof and communicating with said chamber thereof, said handle including at least one slit formed in said lower portion thereof and communicating with said passage thereof, to form at least two blades, and including an outer thread formed in said lower portion thereof, and including an inclined surface formed in said at least two blades, said handle including at least one opening formed therein and communicating with said chamber thereof, a driving shank received in said passage of said handle and to be rotated and driven by said handle, a control ferrule threaded with said outer thread of said handle and engaged with said inclined surface of said at least two blades of said handle, to force said at least two blades to engage with and to grasp said driving shank to said handle, a magazine rotatably received in said chamber of said handle, and including a plurality of compartments formed therein and defined between ribs, for receiving screwdriver bits therein, and including at least one projection extended upwardly therefrom, and including a serrated outer surface provided thereon, said serrated outer surface of said magazine being exposed and reachable via said at least one opening of said handle, to allow said magazine to be rotated relative to said handle by users, a cover attached to said handle, to enclose said chamber of said handle, and to rotatably retain said magazine within said chamber of said handle, said cover including a passage formed therein for selectively aligning with either of said compartments or either of said ribs of said magazine when said magazine is rotated relative to said handle, and said cover including a plurality of depressions formed therein to selectively receive said at least one projection of said magazine, and to anchor and position said magazine relative to said handle at a selected angular position, and to maintain either of said compartments and said ribs of said magazine in alignment with said passage of said cover, the screwdriver bits being engageable into and disengageable from said compartments of said magazine when either of said compartments of said magazine is aligned with said passage of said cover by rotating said magazine relative to said handle, the screwdriver bits being retained within said handle and being prevented from being disengaged from said handle and said magazine when either of said ribs of said magazine is aligned with said passage of said cover, by rotating said magazine relative to said handle and by offsetting said compartments of said magazine from said passage of said cover, and means for biasing said magazine toward said cover, to bias said at least one projection of said magazine to engage into either of said depressions of the cover.

2. The screwdriver as claimed in claim 1, wherein said handle includes a recess formed therein and communicating with said chamber thereof, and having an inner diameter smaller than that of said chamber thereof to form a peripheral shoulder between said recess and said chamber thereof, said magazine includes a shaft extended downwardly therefrom and rotatably engaged in said recess of said handle, to smoothly couple said magazine to said handle.

3. The screwdriver as claimed in claim 1, wherein said magazine includes a space formed therein, said biasing means includes a spring member received in said space of said magazine.

4. The screwdriver as claimed in claim 1, wherein said driving shank includes a socket provided thereon for engaging with the screwdriver bits.

5. The screwdriver as claimed in claim 1, wherein said handle includes at least one catch extended therein, and said cover includes a peripheral wall having at least one notch to receive said at least one catch of said handle, and to enclose said chamber of said handle, and to rotatably retain said magazine within said chamber of said handle.

6. The screwdriver as claimed in claim 1, wherein said magazine includes an axle extended upwardly therefrom, said cover includes a cavity formed therein to rotatably receive said axle of said magazine, and to allow said magazine to be smoothly and rotatably received within said handle by said axle.

7. The screwdriver as claimed in claim 1, wherein said depressions of said cover includes a number equal to a number of said compartments plus a number of said ribs of said magazine.

* * * * *